US006603434B2

(12) United States Patent
Lindenmeier et al.

(10) Patent No.: US 6,603,434 B2
(45) Date of Patent: Aug. 5, 2003

(54) DIVERSITY ANTENNA ON A DIELECTRIC SURFACE IN A MOTOR VEHICLE BODY

(75) Inventors: Heinz Lindenmeier, Planegg (DE); Jochen Hopf, Haar (DE); Leopold Reiter, Gilching (DE)

(73) Assignee: Fura Automotive GmbH & Co. KG, Bad Salzdefurth (DE)

( * ) Notice: Subject to any disclaimer, the term of this patent is extended or adjusted under 35 U.S.C. 154(b) by 0 days.

(21) Appl. No.: 10/041,419

(22) Filed: Jan. 7, 2002

(65) Prior Publication Data

US 2002/0126055 A1 Sep. 12, 2002

(30) Foreign Application Priority Data

Jan. 10, 2001 (DE) ..... 101 00 812

(51) Int. Cl.[7] ..... H01Q 1/32
(52) U.S. Cl. ..... 343/713
(58) Field of Search ..... 343/713, 711, 343/712

(56) References Cited

U.S. PATENT DOCUMENTS

| | | | |
|---|---|---|---|
| 4,914,446 A | 4/1990 | Lindenmeier et al. | |
| 5,097,270 A | 3/1992 | Lindenmeier et al. | |
| 5,266,960 A | 11/1993 | Lindenmeier et al. | |
| 5,801,663 A | 9/1998 | Lindenmeier et al. | |
| 6,236,372 B1 * | 5/2001 | Lindenmeier et al. | 343/713 |

FOREIGN PATENT DOCUMENTS

| | | |
|---|---|---|
| DE | 36 18 452 | 12/1987 |
| DE | 36 19 704 | 12/1987 |
| DE | 37 19 692 | 12/1988 |
| DE | 39 14 424 | 12/1990 |
| DE | 195 35 250 | 3/1997 |
| EP | 0 269 723 | 6/1987 |

* cited by examiner

*Primary Examiner*—Michael C. Wimer
(74) *Attorney, Agent, or Firm*—Collard & Roe, P.C.

(57) ABSTRACT

A diversity antenna for the meter and decimeter wave ranges installed on a conductively framed dielectric surface in the body of a motor vehicle and substantially assembled from rectangular part surfaces, for example in a roof cutout or trunk with a dielectric trunk lid. A substantially wire-shaped antenna conductor is installed parallel with the conductive frame and spaced from a part thereof of the dielectric surface less than one fourth of the width of the dielectric surface. The wire-shaped antenna conductor has an interruption site which define a pair of antenna connection terminals. A two-pole, electronically controllable impedance network is incorporated in series in at least one additional interruption site. The position of the interruption site with the pair of antenna connection terminals, and the position of the additional interruption site are selected so that the antenna signals available at the different settings of the controllable impedance network are adequately decoupled in terms of diversity.

28 Claims, 11 Drawing Sheets

DIVERSITY ANTENNA ON A DIELECTRIC SURFACE IN A MOTOR VEHICLE BODY

BACKGROUND

1. Field of the Invention

The invention relates to a multi-antenna diversity antenna system installed on a conductively framed, dielectric surface in the body of a motor vehicle. This antenna system is for receiving signals in the meter and decimeter wave ranges, for example for radio or television broadcast reception.

2. The Prior Art

Conventional multi-antenna systems are described, for example in European patent EP 0 269 723, and German patents DE 36 18 452; DE 39 14 424, FIG. 14; DE 37 19 692; and P 36 19 704, for windshield and rear window glass panes.

With an adequate high-frequency decoupling of the antennas, reception disturbances occur when the motor vehicle is positioned in different locations in the field of reception. These receiver disturbances occur with temporary level fading events due to the multi-directional propagation of the electromagnetic waves. This effect is explained by way of example in FIGS. 3 and 4 in EP 0 269 723.

When a reception interference occurs in the signal of the antenna of an antenna diversity system that is switched on at a given time, the antenna is reversed to another antenna, and while in a preset field of reception, the number of level fading events leading to reception interference on the receiver input is kept as low as possible. The level fading events, plotted over the driving distance, and thus also over time, do not occur congruently. The probability for finding, among the available antennas, an undisturbed signal, which grows with the number of antenna signals and the decoupling between these signals in terms of diversity.

In the present invention, a decoupling of the antenna signals in a diversity system exists when the reception signals are different, especially when there are reception disturbances such as, when the HF-level faded. To obtain good diversity efficiency, 3 to 4 antenna signals that are adequately decoupled, are required in most practical applications. According to the state of the art, these antenna signals are received on the rear glass window pane of a motor vehicle that is also integrated in the heating field. Therefore, a connection network has to be provided for each antenna. Moreover, an antenna amplifier is also included to provide good signal-to noise ratios. In the great majority of cases, these connection networks are costly, especially in conjunction with the required high-frequency connection lines leading to the receiver.

In the future, modern automobiles will have an increased use of plastic in the auto bodies, for example in the form of plastic trunk lids or plastic components or panels in the otherwise metallic body of the vehicle.

SUMMARY OF THE INVENTION

The present invention is an improvement on DE 195 35 250. The antenna structures 5 and 6 are shown in this patent in FIGS. 2 and 4, for different frequency ranges. The antenna structures are shown in the plastic trunk lid, or in the roof cutout of a vehicle. Separate antennas are specified in DE 195 35 250 for each of the various frequency ranges, to obtain the smallest possible couplings by the greatest possible spacing among the antennas of the different frequency ranges. This patent shows a useful special distribution of the antennas within the confined installation space available.

According to the prior art, it would be necessary to additionally employ four connection networks, i.e. antenna amplifiers, for example for receiving UHF radio broadcasts. Their connection to the body of the vehicle in the site of installation, and their wiring, would be connected with considerable expenditure, and would also be very complicated. To design multi-antenna diversity systems with 4 antennas with antenna amplifiers with a ground connection for diversity-UHF-reception, decoupled from each other, a large spacing is needed between each antenna, and 4 separately disposed antennas for the diversity reception of terrestrial television signals need to be provided according to DE 195 35 250. The installation space of this system is consequently not available because of the relatively large wavelengths of the useful frequency ranges.

Therefore, the present invention provides an installation space-saving diversity antenna for a diversity antenna system in a motor vehicle, with received signals that can be selected in different ways. With this design, the average quality of the reception is as good as possible. In addition, the reception disturbances occur simultaneously in the different antenna signals while driving are kept as small as possible.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION

In the present invention, a multitude of antenna signals that are different in terms of diversity can be generated with only one conductor structure, which is installed in the marginal zone of the dielectric surface in a space-saving manner, and with only one connection network. Electronically controllable impedance networks requiring no ground connection to the vehicle can be provided in a simple and space-saving manner. Furthermore, it is also advantageous that the mobility of the trunk lid is not restricted since the electronically controllable impedance networks do not have to be grounded to the car.

Figure 1A:
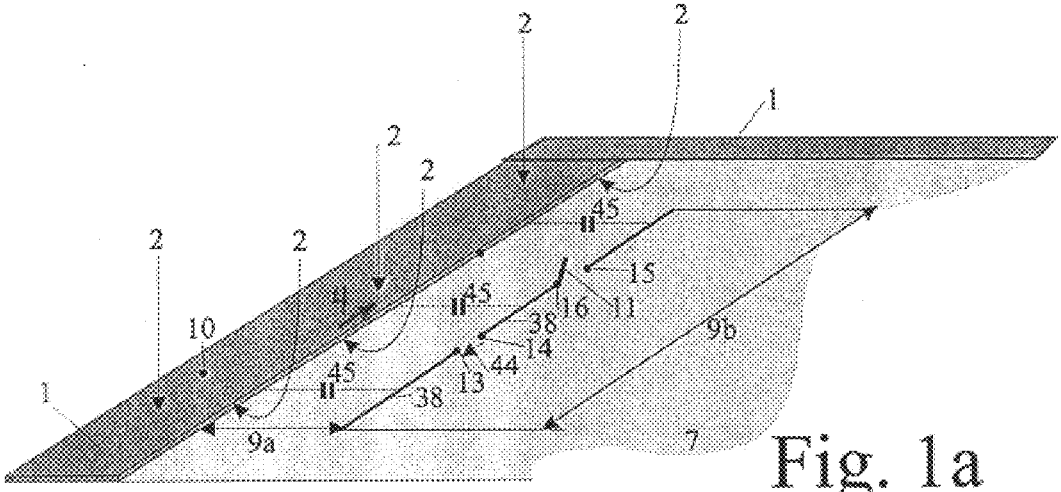
FIG. 1*a* shows an embodiment of a diversity antenna with a wire-shaped antenna installed parallel to a conductive frame, and a controllable impedance network in an additional interruption site.

The mode of operation of the invention is described in the basic configurations of antennas shown in FIGS. 1*a* ▒ 1*h*. In FIG. 1*a,* a wire-shaped antenna conductor 38, having a length 9*b* is installed on a dielectric surface 7, and extends with a spacing 9*a* parallel with a conductive frame 1. Because of the concentration of electrical field lines 2 and magnetic field lines 3 (see FIG. 1*b*), which generate the received electromagnetic waves in the direct proximity of a conductive frame 1, the components of the received signal are coupled both electrically and magnetically into wire-shaped antenna conductor 38 even if the very small spacing 9*a* is relatively large. The edge effect occurring on conductive frame 1 causes a concentration of electric field lines 2, and a concentrated edge current 4 occurring along the edge, which causes the concentration of magnetic field lines 3 in direct proximity to the edge of conductive frame 1. Because of the substantially static distributions of both electric field lines 2 and magnetic field lines 3 in the proximity of the edge, the minimally required spacing 9*a* is not determined by the wavelength of the waves received. It is possible, for example with $\lambda$=3 m wavelength, with a spacing 9*a* of =$\lambda$/50, to achieve adequate antenna properties.

To generate antenna signals that are different in terms of diversity in a suitable site of interruption on a pair of antenna connection terminals 13, 14 with an antenna voltage 44 applied to the terminals, electronically controllable impedance network 1 is serially incorporated in wire-shaped antenna conductor 38. The impedance network is shown as a switch 11. If neither pair of antenna connection terminals 13, 14 nor an electronically controllable impedance network 11 are located at one end of wire-shaped antenna conductor 38, and, furthermore, if the spacing between pair of antenna connection terminals 13, 14 and electronically controllable impedance network 11 is adequately large, different antenna signals 44 are obtained at different impedances at additional interruption site 15, 16. This can be explained by the effect of the capacitance that is continuously operating between wire-shaped antenna conductor 38 and conductive frame 1. The effective partial capacitance is shown by the reference numeral 45. This means that at different impedances, different superimpositions of the magnetic effects ensue because of the loop voltage generated by magnetic field lines 3, and because of the electrical effects caused by electric field lines 2.

Due to the influence exerted by the large size vehicle, which is large in comparison to the wavelength, on the current distribution on the body of the vehicle and thus also on edge current 4, and magnetic field lines 3 associated with the latter, and due to the electric field lines that develop largely uncorrelated therefrom, the different antenna signals 44 are different in terms of diversity as well.

Figure 1B:
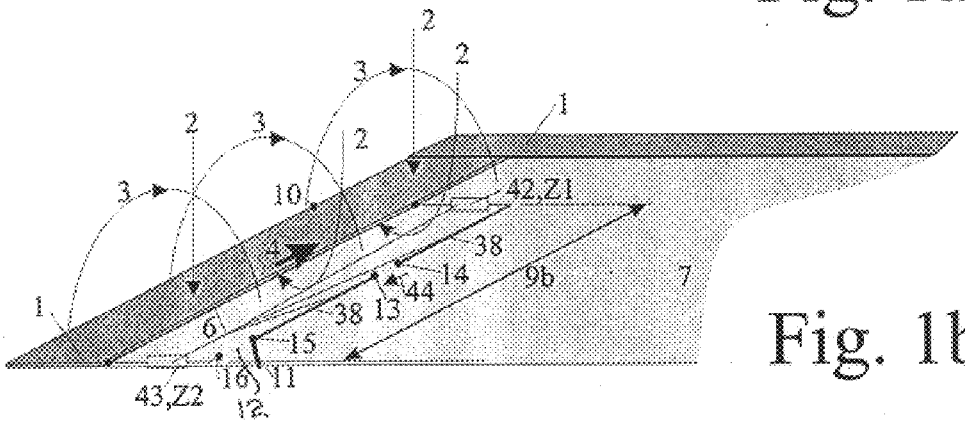
FIG. 1*b* shows another embodiment of the diversity antenna where concentrated impedances are connections to the conductive frame that are effective in terms of frequency.

Referring to FIG. 1*b,* substitute capacitances 45 acting on antenna conductor 38 are supported by the connections 42 and 43 ▒ which are effective in terms of high frequency ▒ in the form of the impedances Z1 and Z2 connected to conductive frame 1. If connections 42 and 43 are effective for high frequency as low impedance by impedances Z1 and Z2, conductive frame 1, low-impedance (in terms of high frequency) connections 42 and 43, as well as antenna conductor 38 jointly form a loop 6 if additional interruption site 15, 16 is also bridged with low impedance by an electronic switching element 12 with corresponding antenna voltage 44. If electronically controllable impedance network 11 is wired for high impedance, antenna voltage 44 is varying in terms of diversity.

Figure 1C:
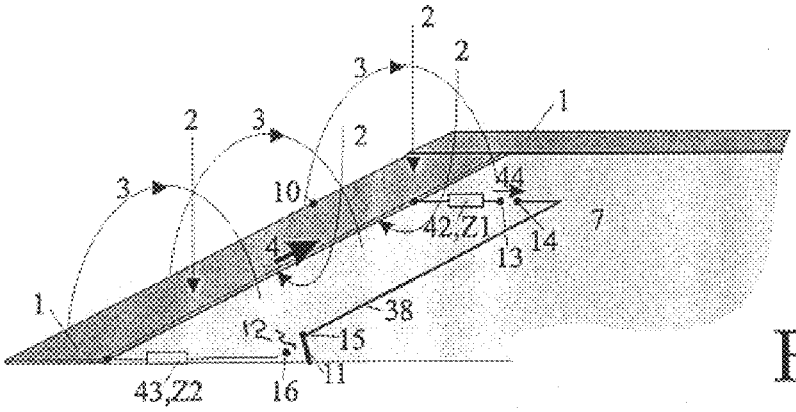
FIG. 1*c* shows a diversity antenna with a pair of connection terminals wired serially to the impedance.

FIG. 1*c* shows another basic configuration of the invention having pair of antenna connection terminals 13, 14 serially integrated to impedance Z1 in one of connections 42 and 43 of wire-shaped antenna conductor 38. These connections are effective for of high frequency signals.

Figure 1D:
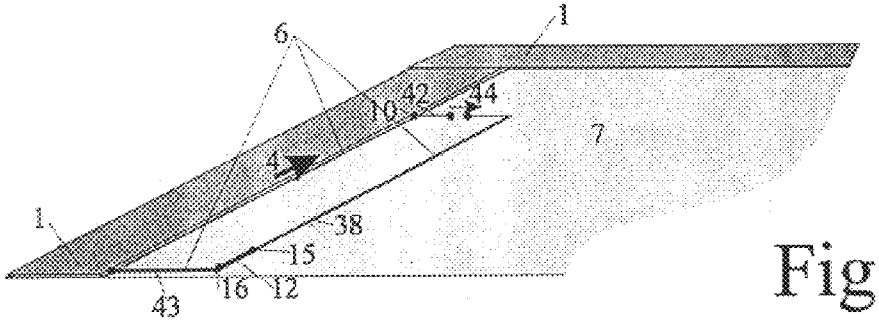
FIG. 1*d* shows a diversity antenna with a pair of connection terminals in a low impedance connection.

FIG. 1*d* shows another embodiment of an antenna as defined by the invention, where wire-shaped antenna conductor 38 has at its ends, connections 42 and 43 leading to conductive frame 1, so that it is possible with the help of different impedances of electronically controllable impedance network 11 to reverse between a magnetically receiving antenna effect at low impedance, and an electrically receiving antenna at high impedance, the latter being uncorrelated from the former.

Figure 1E:
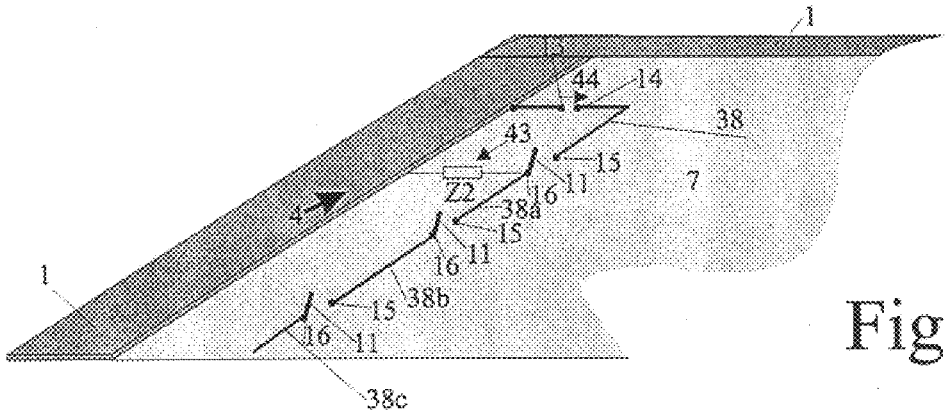
FIG. 1*e* shows the diversity antenna of FIG. 1*c* with an additional antenna conductor instead of a connection acting as the impedance.

In an advantageous further embodiment of the invention in FIG. 1*c,* a first additional antenna conductor 38*a* is connected as shown in FIG. 1*e,* to one of the two ends of antenna conductor 38. This first additional antenna conductor 38*a* is designed so that the load associated with the high frequency connection is matched or corresponds with a suitably adjusted impedance Z2 and forms the active high frequency connection. If a second additional antenna conductor 38*b* is connected to the other end of first additional antenna conductor 38*a,* also second additional antenna conductor 38*b* defines a continuation of this principle so that the load associated in terms of high frequency with the connection is matched or corresponds with the suitably adjusted impedance, and forms high frequency connection 43 or 42.

Second additional antenna conductor 38*b* is installed parallel to another partial section of frame 1. In the example shown, antenna voltage 44 is tapped, based on ground potential, on pair of antenna connection terminals 13, 14. If each of the additional antenna conductors with additional interruption sites 15, 16, has an electronically controllable impedance network 11 with a suitable spacing between the networks, the structure shown in FIG. 1*e.*

With different adjustments of electronically controllable impedance networks 11, it is possible to obtain a great variety of antenna voltages 44 that vary in terms of diversity. The advantage of this arrangement according to the invention, is that the different antenna signals are available in one single antenna connection site, on a pair of antenna connection terminals 13, 14, and the signals can be tapped by one single connection network 25. With antennas mounted apart from each other, the need to have many such connection networks 25, as well as their connection to an additional common connection network 25, to further process the signals in the diversity system are thus eliminated. The preferred spacing between the electronically controllable impedance networks 11 should not be smaller than about $\lambda/8$. The particularly preferred spacing is $\lambda/4$ or greater.

Figure 1F:
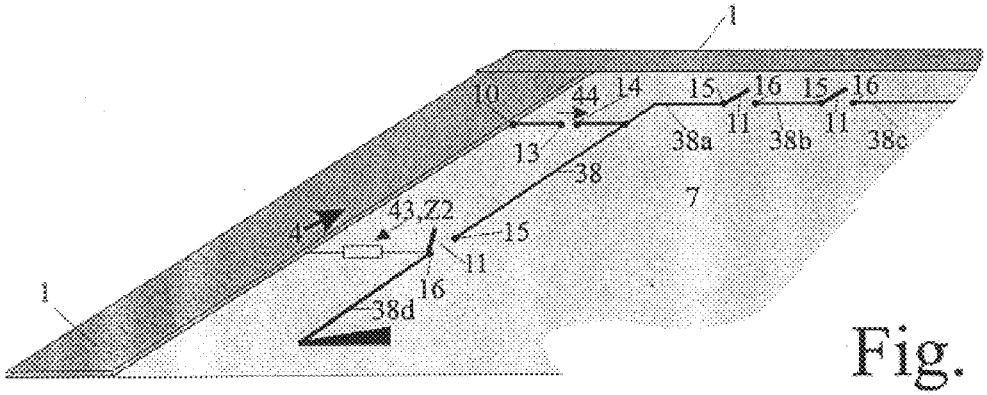
FIG. 1*f* shows the diversity antenna of FIG. 1*e* with an extension of the wire-shaped antenna conductor on both sides with additional antenna conductors.

In FIG. 1*f,* to expand the variety of available antenna voltages 44, the invention is analogously continued in connection with ground-based tapping of antenna voltage 44 by designing active impedance Z2 instead of connection 43 by suitably shaping an antenna conductor 38*d.* At its other end, wire-shaped antenna conductor 38 is designed with additional antenna conductors 38*a,* 38*b,* 38*c* etc. in a manner analogous to FIG. 1*e.*

Figure 1G:
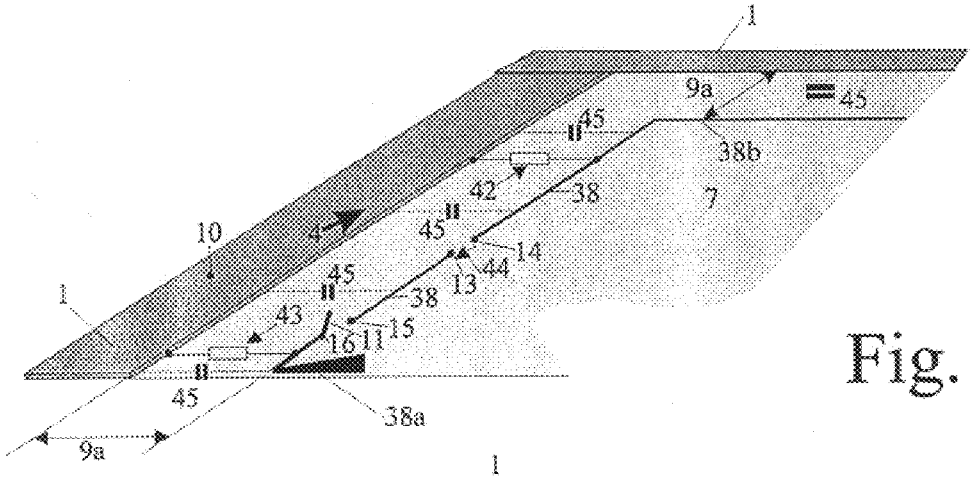
FIG. 1*g* shows the diversity antenna of FIG. 1*a* with the an extension of the wire-shaped antenna conductor on both sides by additional antenna conductors.

In another advantageous variation of the invention, antenna voltage 44 can be tapped ground-free by placing pair of antenna connection terminals 13, 14 in the form of an interruption site in the part of wire-shaped antenna conductor 38 installed in parallel with conductive frame 1. As shown in FIG. 1*g,* wire-shaped antenna conductor 38 is extended on both sides by additional antenna conductors 38*a* and 38*b,* respectively.

Figure 1H:
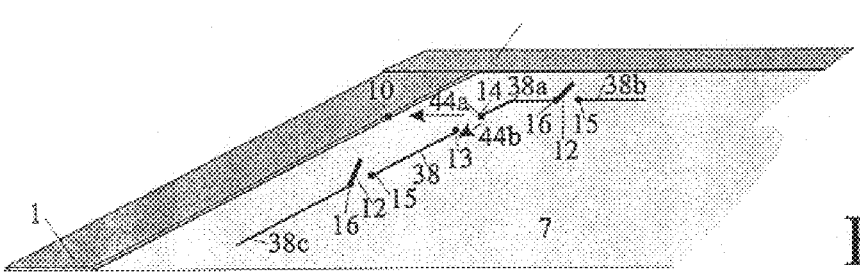
FIG. 1*h* shows the diversity antenna of FIG. 1*g* where one pair of connection terminals tap the ground-free antenna signals, and another pair of connection terminals tap the ground-based antenna signals.

As a particularly advantageous variation of the invention, FIG. 1*h* shows that a first interruption site for a pair of antenna connection terminals 13, 14 in wire shaped antenna conductor 38, is provided for the ground-free tapping of an antenna voltage 44*b.* An additional pair of antenna connection terminals 14, 10 is provided for tapping a received voltage signal 44*a,* which is different from antenna voltage 44*b* in terms of diversity. Ground-based antenna voltage 44*a* is tapped between interruption site 14 of antenna conductor 38 and conductive frame 1, which is defined by ground point 10. By tapping both antenna voltages 44 in a common site, is it thus possible to process both signals in a single connection network 25.

Figure 2:
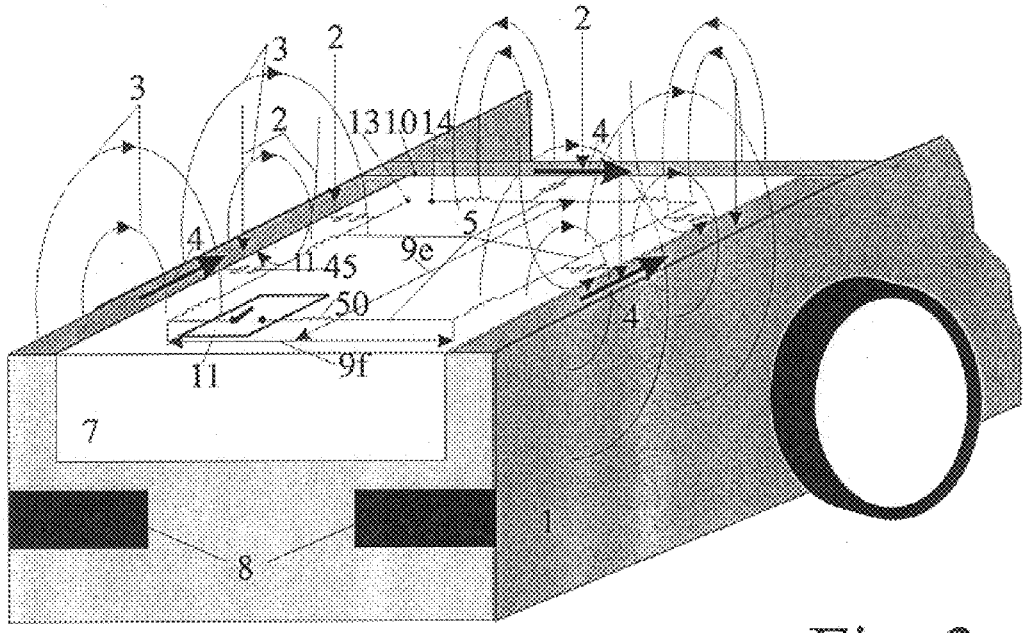
FIG. 2 shows the development of the antenna signals, on the pair of antenna connection terminals caused by the magnetic and electric effects.

FIG. 2 shows a mode of operation of an advantageous basic configuration of an antenna of the invention located in the plastic lid of an automobile trunk. The plastic or non-conductive lid represents dielectric surface 7. Antenna conductor 38 is designed in the present case in the form of ring structure 5 having a width 9*f* and a length 9*e,* and extends substantially parallel to the three part pieces or sides of conductive frame 1. The antenna signals on pair of antenna connection terminals 13, 14, which are different in terms of diversity, are generated by the different adjustments of electronically controllable impedance network 11. Here the antenna signals can be tapped both ground-free on pair of terminals 13 and 14, or be ground-based on pair of terminals 13 and 10 and, respectively, 14 and 10.

The different excitation of the ring structure with additional interruption site 15, 16 is based on the fact that at the different adjustments of electronically controllable impedance network 11, with the ring structure open and closed with ground-based tapping of the antenna signal, and ground-free tapping of the antenna signal, the electric and magnetic excitations cause different effects, so that the desired variety of antenna signals varying in terms of diversity is obtained. This is clearly illustrated by the substitute circuit diagram with the substitute elements of substitute inductances 50 and substitute capacitances 45 in conjunction with electric filed lines 2, and magnetic field lines 3.

Figure 3:
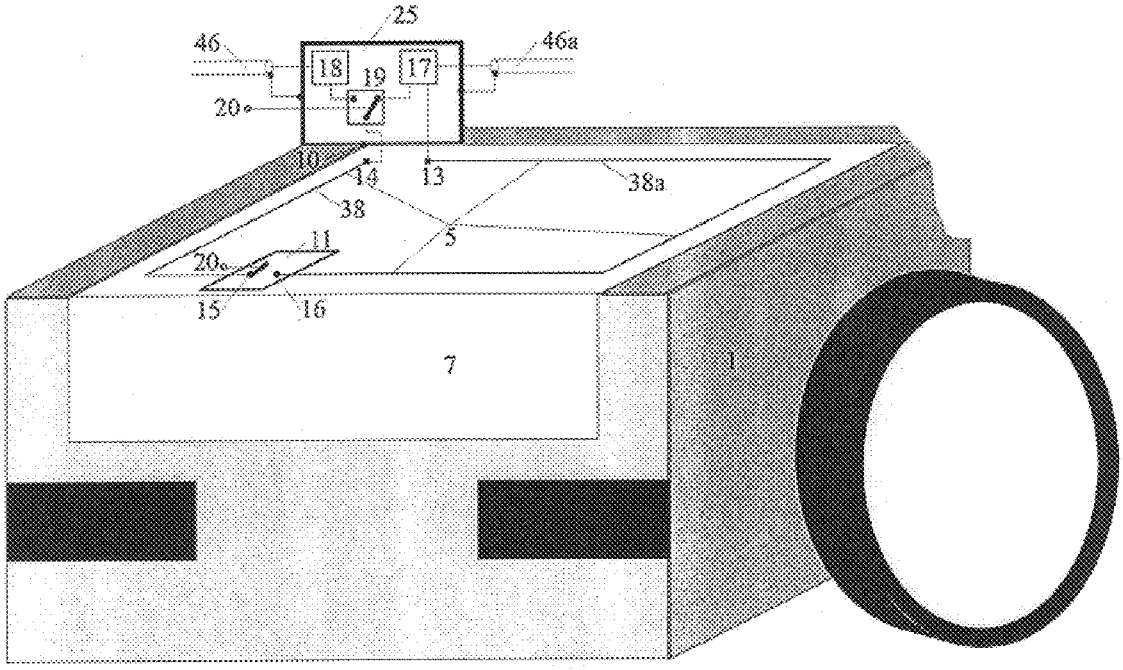
FIG. 3 shows a diversity antenna according to FIG. 2 where the connection network contains adapter networks and amplifiers.

FIG. 3 shows the design of an antenna according to FIG. 2. Here, the antenna signals are supplied to connection network 25. Antenna connection network 25 contains an adapter network and/or amplifier 17 for decoupling the antenna signals ground-free on terminals 13, 14, and an adapter network and/or an amplifier 18 for decoupling the antenna signals ground-based between terminals 14 and 10. An electronic change-over switch 19, can be used to selectively supply one of the two antenna signals via network components 17, 18, for example via separate antenna connection lines 46, 46*a.*

A control signal 20 for controlling reversing switch 19, can be jointly used to also control electronically controllable impedance network 11 in the form of electronic switching element 12, to effect a separation of the ring structure in terms of high frequency. Control signal 20 may be derived, for example from a diversity processor.

Figure 4:
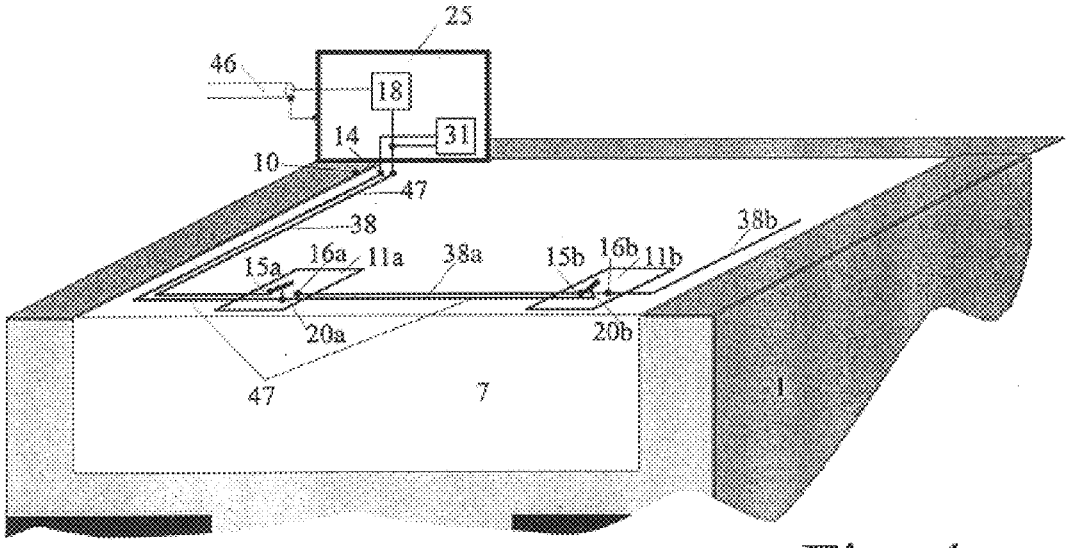
FIG. 4 shows a diversity antenna installed in the trunk lid of a motor vehicle with a switching processor contained in the connection network.

FIG. 4 shows an advantageous design of antenna conductor 38 according to FIG. 1*e* on the lid of a car trunk. Antenna conductor 38 is expanded by first additional antenna conductor 38*a* and second additional antenna conductor 38*b,* which are connected by additional interruption sites 15*a,* 16*a,* and 15*b,* 16*b* via electronically controllable impedance networks 11*a* and 11*b.* Electronically controllable impedance networks 11*a* and 11*b* are controlled with a switching processor 31 implemented in connection network 25. Switching processor 31 supplies control signals 20 for control signal inputs 20*a* and 20*b,* which are supplied to the control signal inputs via a control line 47 that is ineffective at high frequency, for generating the different (in terms of diversity) antenna signals on the input of the adapter network and/or of amplifier 18 for ground-based antenna signals.

Figure 5:
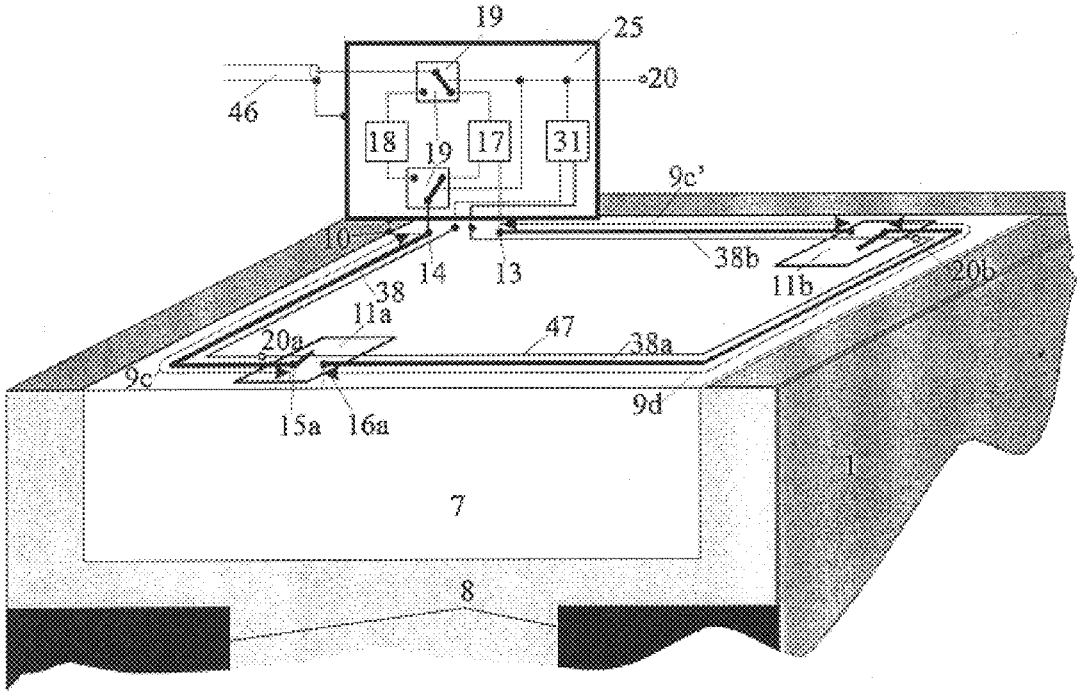
FIG. 5 shows a diversity antenna as shown in FIG. 4 with two electronically controllable impedance networks in a system having a ring structure.

In FIG. 5, which is derived from FIGS. 3 and 4, two electronically controllable impedance networks 11*a* and 11*b* are incorporated in the ring structure, which is an advantageous further development of the invention. If controllable electronic impedance networks 11*a* and 11*b* are designed as electronic switching elements 12 in the form of PIN-diodes, antenna conductor 38 can additionally assume the function of control line 47 if the following antenna signals have to be tapped: when electronic switching elements 12 are opened, it is possible to tap, for example three different antenna signals as follows: (a) ground-based tapping on pair of terminals 14, 10; (b) ground-based tapping on pair of terminals 13, 10; and (c) ground-free tapping on pair of terminals 13, 14.

When electronic switching elements 12 are switched to conducting, an antenna signal that is different from the signal input (c) can be tapped on pair of terminals 13, 14. Therefore, to obtain four (4) different antenna signals, switching processor 31 has to be activated only once via control signals 20. Electronic change-over switches 19, controlled by control signals 20, supply the antenna signals to the adapter network and/or amplifier 17 for antenna signals tapped ground-free, or 18 for antenna signals tapped ground-based. On the output side in adapter network 25, the adapted or amplified antenna signals are supplied to an antenna connection network 46 via electronic change-over switch 19 in response to control signals 20.

FIGS. 6*a*–6*h* show a few examples of advantageous embodiments of electronically controllable impedance networks 11. These networks do not require any connections to the ground of the vehicle in their installation sites if control signals 20 for controlling the impedances of electronically controllable impedance networks 11 are either directly transmitted via wire-shaped antenna conductor 38, or provided in accordance with the invention via control lines 47, 47*a*, 47*b*. These are connected directly parallel with wire-shaped antenna conductor 38 which is ineffective at high frequency, so that the strand is electrically acting like wire-shaped antenna conductor 38. Electronically controllable impedance networks 11 are preferably designed as an electronic switch 12, whereby the switching or PIN-diodes 22 are preferably used as switching elements. If control signals 20 are to be supplied across electronically controllable impedance network 11 to an additional wire-shaped antenna conductor 38 with control line 47, 47*a*, 47*b*, this is accomplished according to the invention by using an inductor 21 in order to not impair the longitudinal impedance of electronically controllable impedance network 11, if switching diode 22 is wired for high impedance. Advantageous embodiments for various cases of application are shown in FIGS. 6*a* to 6*h*.

Figure 6A:
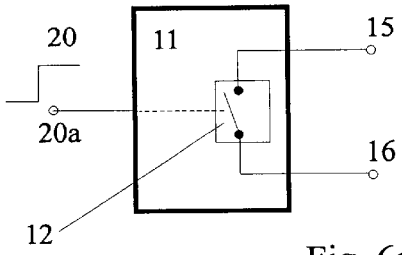
FIG. 6*a* shows a basic function diagram of an electronically controllable impedance network with a switching element, control unit, control signal, and connected terminals.

FIG. 6*a* shows the basic circuit diagram of electronically controllable impedance network 11 in its simplest form. Impedance network 11 has only electronic switching element 12, which is switched on its control input 20*a* via control signal 20. Thus, the electronic switching element functions as a switch with terminals 15 and 16.

Figure 6E:
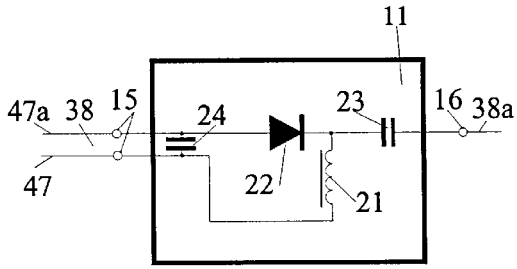
FIG. 6*e* shows an electronically controllable impedance network having two parallel wired control lines.
Figure 6B:
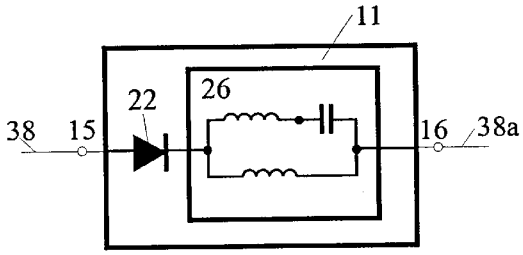
FIG. 6*b* shows an electronic switching element in the form of switching or PIN-diode.

In FIG. 6*b*, electronic switch 12 is designed as a switching or PIN-diode 22. Antenna conductor 38 assumes at the same time, the function of control line 47. An impedance network 26 is designed so that the UHF-frequency range is passable via the series resonance circuit, whereas all other radio frequencies are blocked. The inductance connected in parallel passes on the direct current, on the one hand, and a parallel resonance can be generated, in television band 1, on the other hand, so that the blocking effect of impedance network 26 is increased in the frequency range.

Figure 6F:
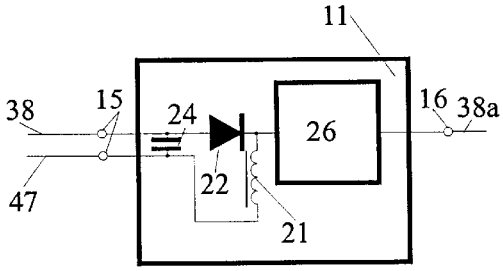
FIG. 6*f* shows the electronically controllable impedance network of FIG. 6*e* with an impedance network passing on antenna signals in a frequency selective manner.
Figure 6C:
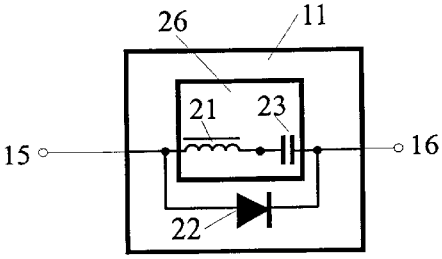
FIG. 6*c* shows an electronically controllable impedance network designed for permitting passage in the AM frequency range and for blockage of the higher radio frequency ranges by an inductor.

In FIG. 6*c*, electronically controllable impedance network 11 is designed to permit passage of the AM frequency range, but block the higher radio frequency ranges by inductor 21. A capacitor 23 separates the direct current. With diode 22, which is wired for low impedance, components of antenna conductor 38*a* can be connected to antenna conductor 38.

Figure 6G:
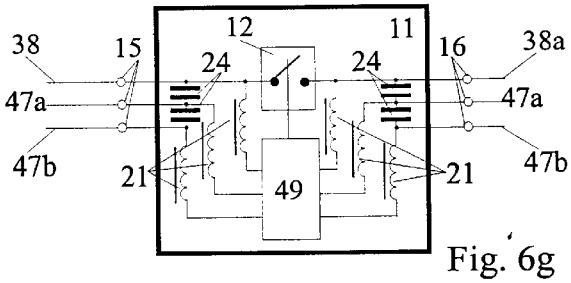
FIG. 6*g* shows an electronically controllable impedance network with a logic circuit interconnected via wire-shaped conductors.
Figure 6D:
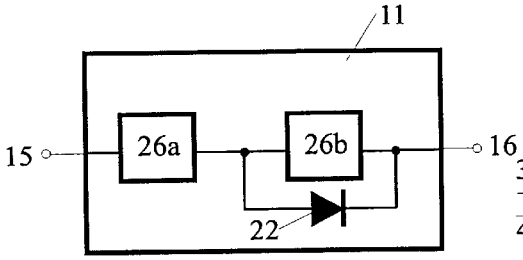
FIG. 6*d* shows an electronically controllable impedance network with an impedance network blocking the VHF/UHF frequency ranges and permitting AM and FM signals.

In FIG. 6*d*, electronically controllable impedance network 11 is designed so that an impedance network 26*a*, blocks the VHF/UHF frequency ranges, but permits passage of the AM- and FM-signals, whereas an impedance network 26*b* permits passage of the AM- and FM-signals, but blocks the FM frequency range.

FIG. 6*e* shows electronically controllable impedance network 11 having two parallel wired control lines 47 and 47*a* for the ▒ to and fro ▒ current of control signal 20 with a coupling capacity 24 for jointly forming wire-shaped antenna conductor 38 and, respectively, 38*a*, and, respectively, 38*b* etc. Inductor 21 blocks high-frequency signals when diode 22 is blocking.

FIG. 6*f* shows an electronically controllable impedance network 11 as in FIG. 6*e*, but with an impedance network 26 to pass on antenna signals in a frequency-selective manner.

FIG. 6*g* shows the basic circuit diagram of electronically controllable impedance network 11 that permits an addressable switching function, for example via a stepped dc voltage as control signal 20. If, for example, several electronically controllable impedance networks 11 in ring structure 5 are to be addressable at different points in time, for different frequency ranges, in different positions in ring structure 5, at least 2 conductors are required for their control. The use of three conductors is also useful. One conductor is formed by antenna conductor 38 itself. Two additional conductors 47*a* and 47*b* form the control lines. All 3 conductors are connected in parallel at high frequency via coupling capacitors 3, and act as antenna conductor 38 if they are spaced closely to each other. Control line 47*a* supplies, the switching address signal as a stepped dc voltage in the simplest case. Antenna conductor 38 may additionally supply a supply dc voltage for the switching signal evaluation in a logic circuit 49, and control line 47*b* serves as the return conductor. These lines are coupled on the input and output of electronically controllable impedance network 11 to logic circuit 49 via inductor 21, which are specifically high-resistive in the viewed frequency range. The evaluation of the switching address signal in logic circuit 49 can be designed in the simplest manner via window discriminators.

Figure 6H:
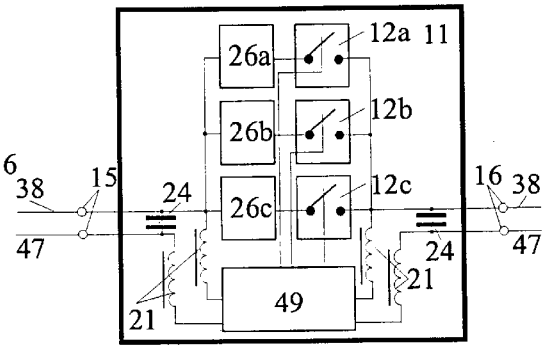
FIG. 6*h* shows the electronically controllable impedance network of FIGS. 6*f* and 6*g* with frequency-selective addressing in different frequency ranges.

FIG. 6*h* shows electronically controllable impedance network 11 that is designed and wired addressable for different frequency ranges.

Figure 7:
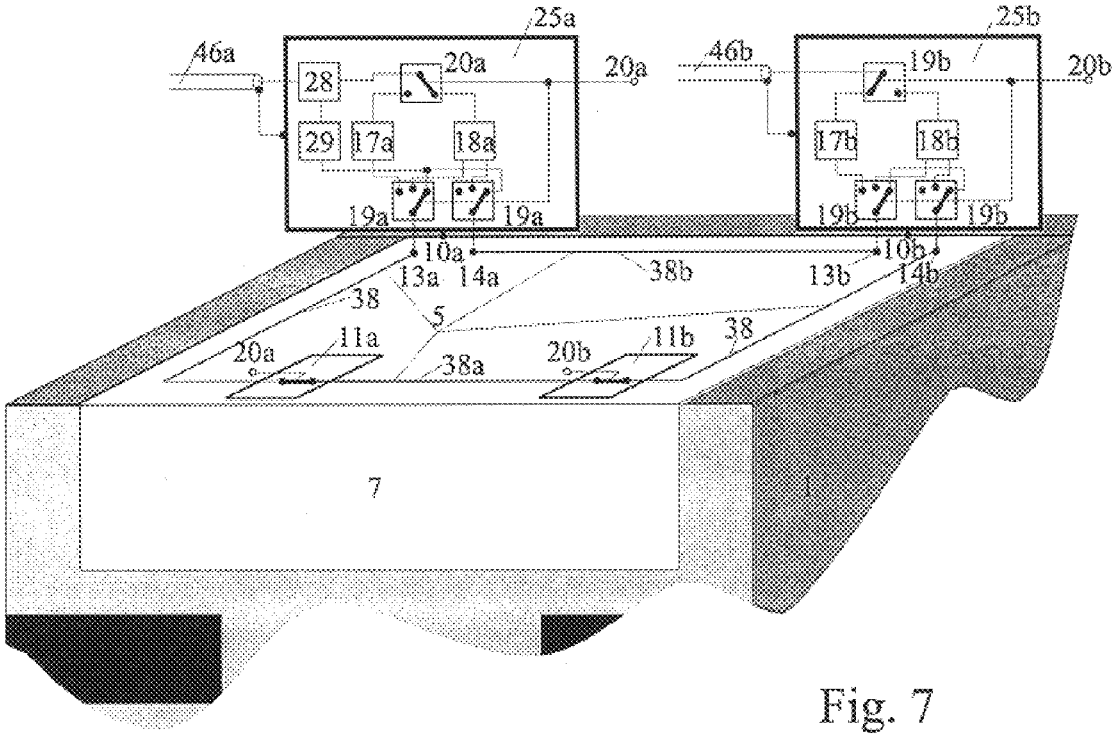
FIG. 7 shows the diversity antenna system of FIG. 5 with two connection networks near the trunk lid hinges.

FIG. 7, shows the antenna of FIG. 5 installed in the trunk lid, and expanded by connection network 25 to increase the variety of the antenna signals varying in the terms of diversity. The unproblematic installation of two connection units 25*a* and 25*b* in the proximity of the hinges of the trunk lid, with the possibility of connecting to the ground of the vehicle, permits the evaluation of several different signals, both ground-free and ground-based with the help of different switch positions in connection networks 25*a* and 25*b*. Selected antenna voltages 44 are separately available on antenna connection lines 46, 46*a*. These signals can be supplied in an advantageous manner to an antenna diversity receiver with two signal inputs for in-phase superimposition of the received signals. These receivers are preferably used for VHF radio reception and are known, for example from U.S. Pat. No. 4,079,318 as well as U.S. Pat. No. 5,517,696.

These diversity receivers provide in-phase superimposing of two or more antenna signals in the sum branch providing a stronger useful signal than the one obtained with one single antenna. By supplementing this diversity system with a scanning diversity system, having a detector to indicate reception disturbances in the sum branch, and with a diversity processor 30 to generate control signals 20 to select two undisturbed signals in antenna connection lines 46, 46*a,* it is possible with an antenna of the invention to greatly reduce the frequency of reception disturbances in the area with multi-directional propagation and level fading events.

Figure 8:
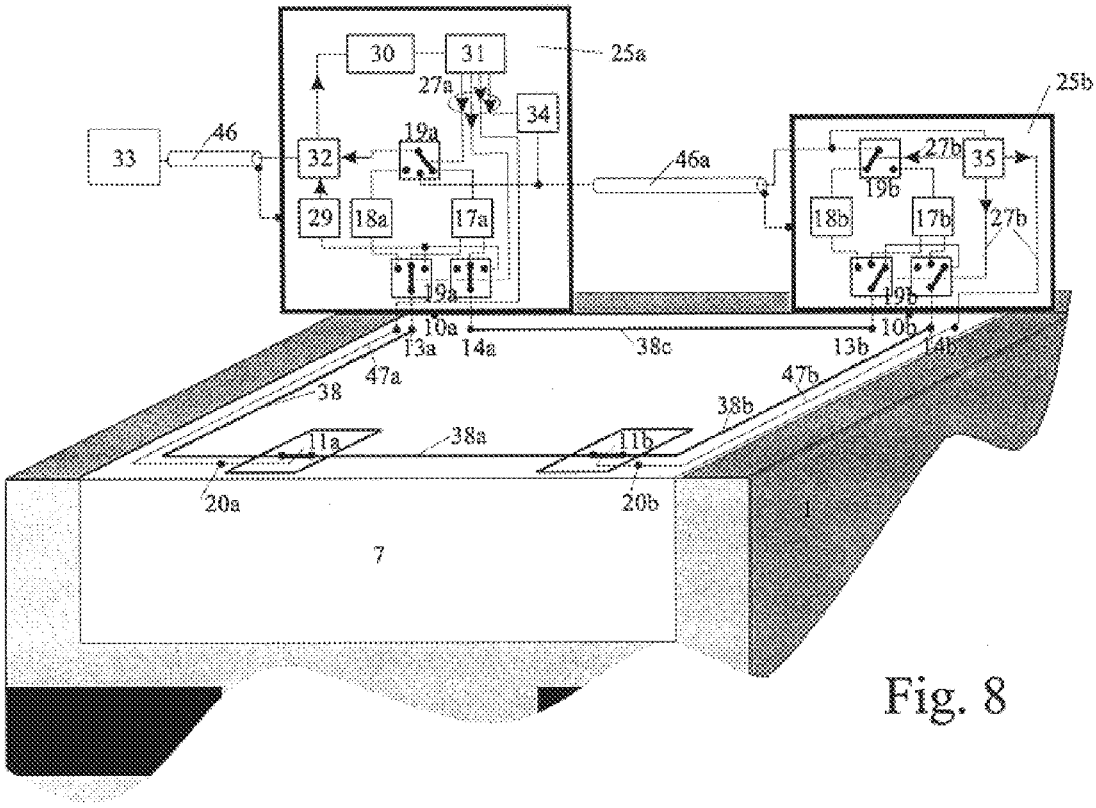
FIG. 8 shows the diversity antenna system of FIG. 7 with a receiver having a diversity processor, switching processor, switching address signal feed, HF/IF frequency switch, electronic change-over switches, and AM-amplifiers.

For a pure scanning diversity system with only one antenna signal 44 that is selected at each point in time, and supplied to a receiver 33 via antenna connection line 46, FIG. 8 shows an advantageous further development of the antenna system over that of FIG. 7. Here, antenna voltage 44 selected in antenna connection network 25*b,* with the help of electronic change-over switch 19, is supplied via antenna connection line 46*a* to connection network 25*a* to be selectively available for further transmission to antenna connection line 46. The intermediate frequency (IF) signals coming from a receiver 33 are supplied to diversity processor 30 having a switching processor 31 with the help of a HF/IF frequency switch 32. The diversity processor controls both electronic change-over switch 19 and a switching address signal feed 34. The switching signals transmitted via antenna connection line 46*a,* control via a switching address signal evaluation 35, electronic change-over switches 19*b,* and initiate control signals 20 for controlling electronically controllable impedance networks 11. An AM-amplifier 29 may be additionally accommodated in connection network 25*a.* The network components 17 and 18 are also integrated in the connection networks 25*a* and 26*b,* respectively.

Figure 9:
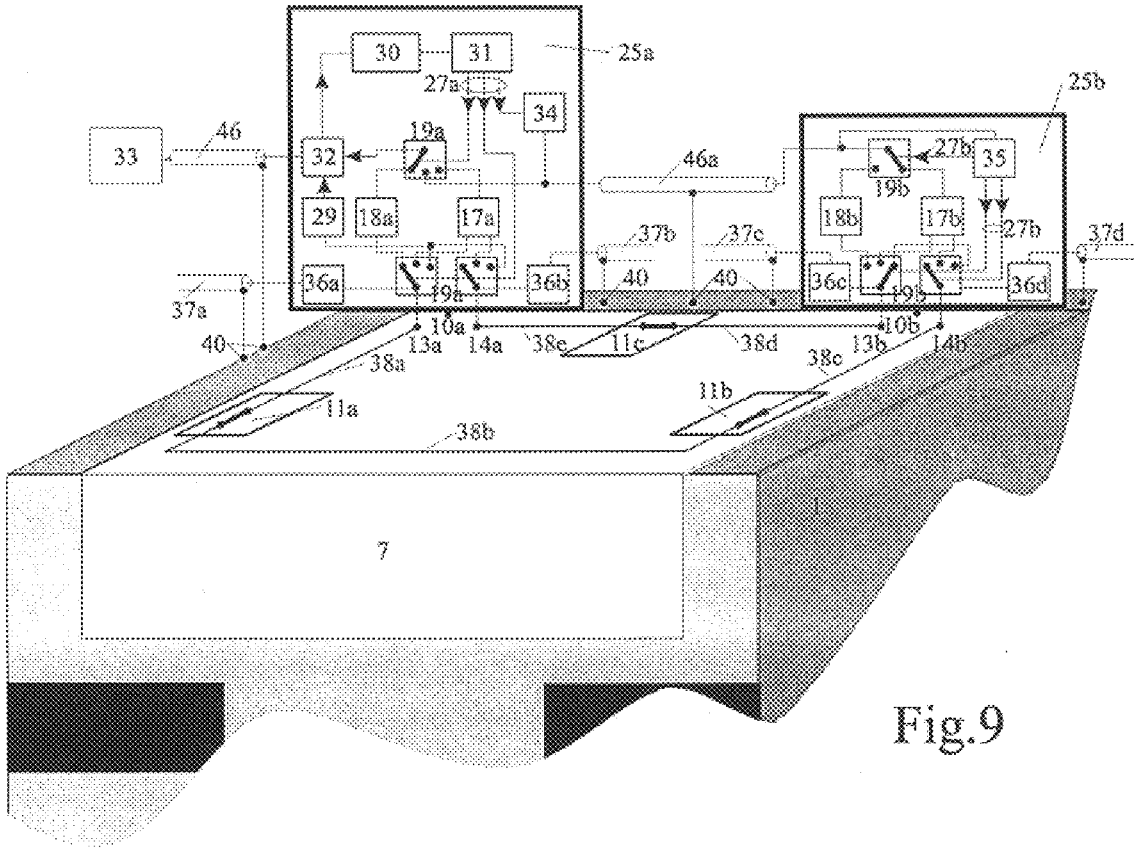
FIG. 9 shows the diversity antenna system of FIG. 8 expanded with 4 TV-antennas with television amplifiers and television connection cables.

In a further development of the invention of FIG. 9, the antenna system as shown in FIG. 8 can be expanded in a very advantageous manner by 4 TV antennas with TV amplifiers 36*a,* 36*b,* 36*c,* 36*d* for the terrestrial television signals (Bd1, VHF, UHF). Modern television diversity systems frequently require 4 separate antenna signals that need to be available at the same time. In FIG. 9, the signals are supplied to the TV diversity system via television antenna connection cables 37*a,* 37*b,* 37*c,* 37*d.*

Figure 10:
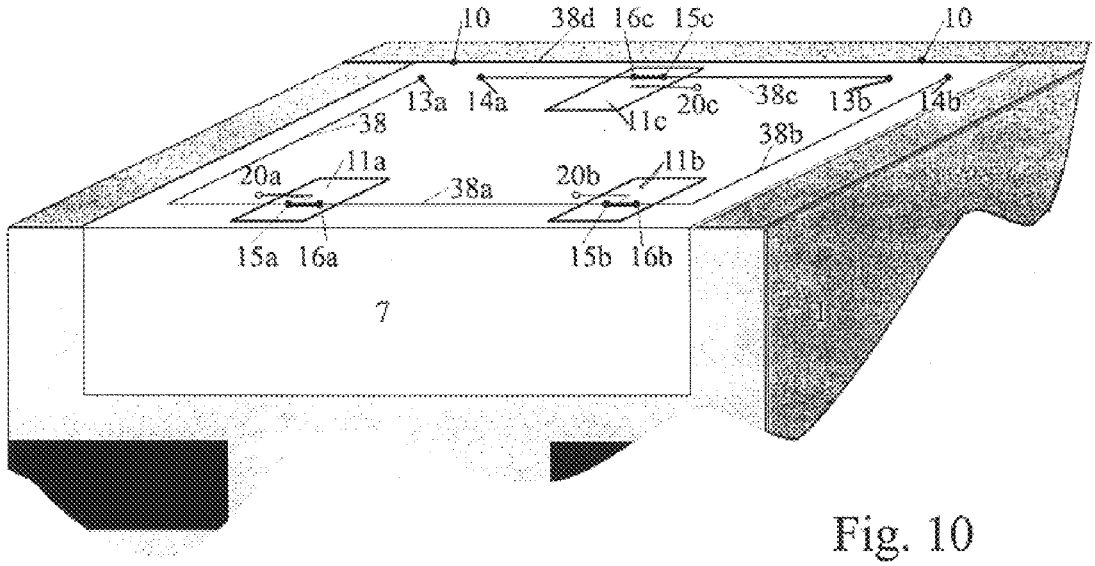
FIG. 10 shows the diversity antenna system of FIG. 9 with HF-connections for 4 different FM-received signals for the 4 different television received signals and an AM-received signal.

The antenna system of FIG. 9 and FIG. 10 shows an example of the HF-connections closed in electronically controllable impedance networks 11*a,* 11*b,* 11*c* for the 4 different FM-receiver signals FM1 to FM4, for the 4 different TV receiver signals TV1 to TV4, and for one AM receiver signal. Antenna signals with very high diversity efficiency are achieved with a ring structure having three electronically controllable impedance networks 11, and only two connection networks 25. These signals are obtained by selecting an advantageous spacing between electronically controllable impedance networks 11 among one another, and then between connection networks 25 and electronically controllable impedance networks 11. With the preset ring structure, a spacing 9*d* (see, for example FIG. 5), which is not smaller than about $\lambda/8$, was found to be very advantageous. Safe diversification of the antenna signals is achieved with a spacing of $\lambda/4$ and more. Such a spacing can be maintained in passenger cars with the VHF and the higher VHF/UHF frequencies. Because of the possible proximity of wire-shaped antenna conductor 38 to the edge of the trunk lid and the small structural size of electronically controllable impedance networks 11, much space remains available in the center of the horizontal surface for accommodating telephone and satellite antennas, or additional antenna structures for additional services, such as remotely acting functions. Their connection cables will not, however, impair the function of the diversity antenna as defined by the invention. For example, sheath currents on the telephone feed cables can be prevented by taking suitable measures in the frequency range used by the diversity antenna, or by effectively decoupling the diversity antenna through suitable installation of the cables. Owing to the strong electromagnetic coupling of wire-shaped antenna conductor 38 with conductive frame 1 of the dielectric trunk lid in the closed condition, coupling with the other antenna can be kept advantageously small. The following table illustrates the different connections of the antenna system for different types of reception.

| Antenna | Connection Terminals | Connection Type | Closed Connections |
|---|---|---|---|
| AM | 13a, 10 | ground-based | 15a-16a, 15b-16b, 13b-14b, 15c-16c, 13a-14a |
| FM1 | 13a, 10 | ground-based | |
| FM2 | 13a, 14a | ground-free | 15a-16a, 15b-16b, 13b, 14b, 15c-16c |
| FM3 | 14b, 10 | ground-based | |
| FM4 | 13b, 14b | ground-free | 15b-16b, 15a-16a, 13a-14a, 16c-15c |
| TV1 | 13a, 10 | ground-based | |
| TV2 | 14a, 10 | ground-based | |
| TV3 | 13b, 10 | ground-based | |
| TV4 | 14b, 10 | ground-based | |

Figure 11:
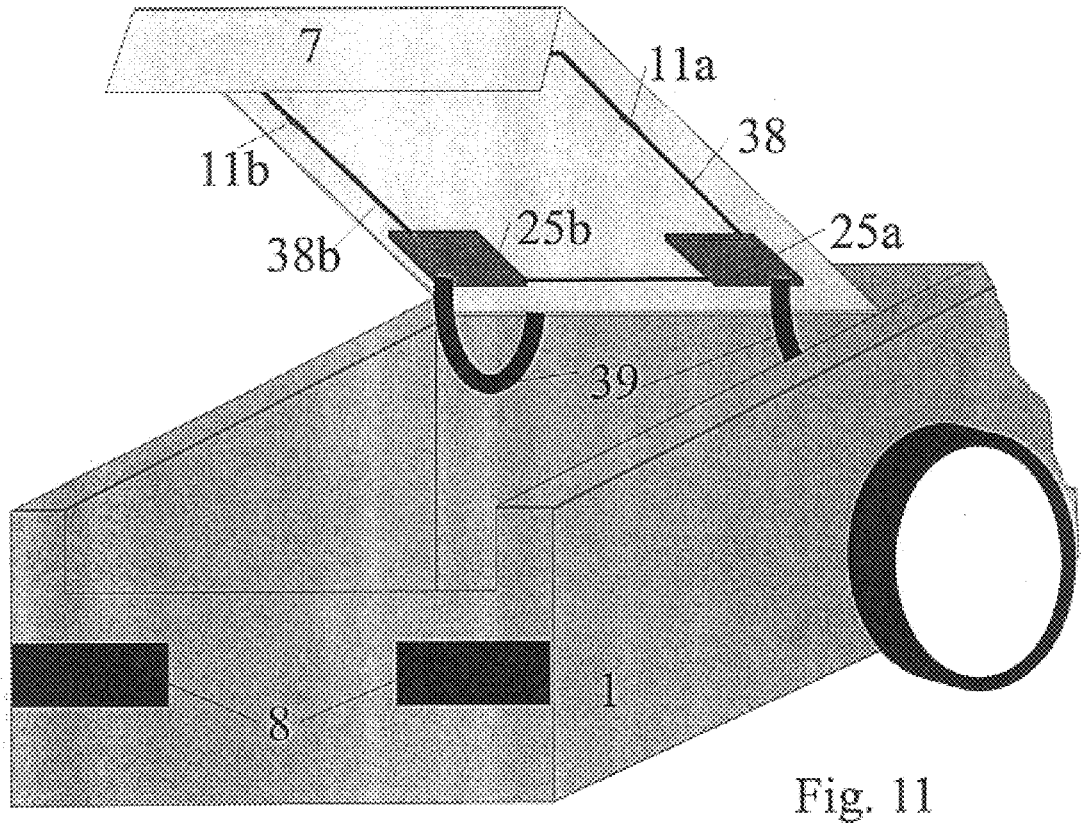
FIG. 11 shows an arrangement of the elements for the diversity antenna system in FIG. 10 in a trunk lid folded open; and, FIG. 12 shows an arrangement of a diversity antenna system as defined by the invention in the cutout of the roof of a motor vehicle.

FIG. 11 shows for an antenna system according to FIGS. 7, 8, 9 and 10, an advantageous arrangement of the elements of the antenna system as seen in the folded-open trunk lid. The ground relation for connection networks 25 can be designed via trunk lid fastening elements 39, which are always metallic.

Figure 12:
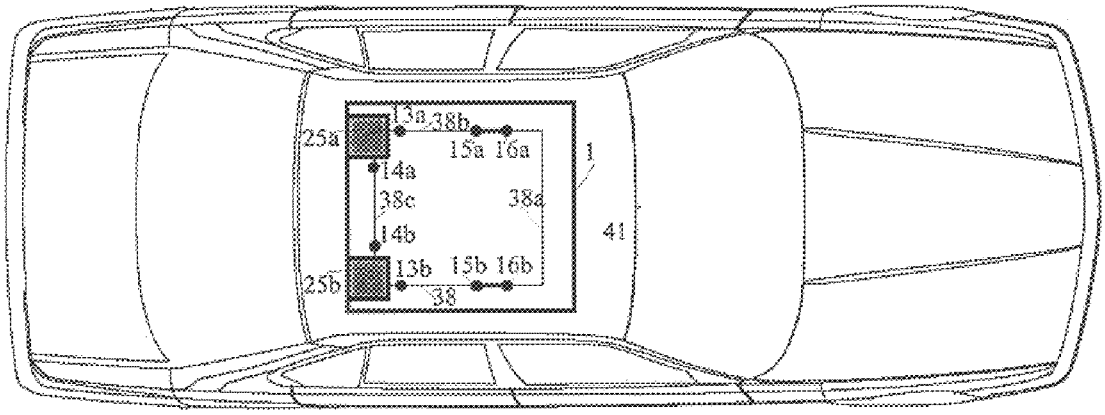

In modern automobile manufacturing, plastic panels are used also in cutouts of a metallic roof 41 of the vehicle. FIG. 12 shown an embodiment of the antenna system according to the invention as it can be used in a roof cutout in a manner analogous to FIGS. 7, 8 and 9.

Accordingly, while several embodiments of the present invention has been shown and described, it is to be understood that many changes and modifications may be made thereunto without departing from the spirit and scope of the invention as defined in the appended claims.

What is claimed is:

1. A diversity antenna for connection to a receiver located on a conductively framed dielectric surface substantially assembled from rectangular partial surfaces in a body of a motor vehicle, comprising:

an antenna conductor in a form of a wire disposed parallel to at least a portion of the conductive frame of the dielectric surface with a spacing of less than one fourth of the width of the existing dielectric surface, wherein said antenna conductor includes at least one interruption site defining a pair of antenna connection terminals and forming at least two antennas; and at least one two-pole electronically controllable impedance network serially integrated in said at least one additional interruption site, wherein a position of said at least one interruption site with said pair of antenna connection terminals and a position of said at least one additional interruption site are selected so that a plurality of antenna signals available at different adjustments of said controllable impedance network are adequately decoupled to select a most suitable signal selected from said plurality of antenna signals.

2. The diversity antenna according to claim 1, wherein said antenna conductor is installed parallel to at least a part of the conductive frame of the dielectric surface, with a spacing from the conductive frame that is small compared to a length of said antenna conductor and as compared to the wavelength, said antenna conductor being adapted at each of its ends to form adequately low-resistant connections in terms of diversity with the conductive frame, and wherein a high-frequency loop is formed jointly by said antenna conductor and the conductive frame.

3. The diversity antenna according to claim 2, wherein said two-pole, electronically controllable impedance network is adapted as an electronic switch, and said pair of antenna connector terminals are adapted as impedances Z1, and respectively, Z2, to said impedances having impedance values so that antenna signals available on said pair of antenna connection terminals in a plurality of different switching conditions of said electronic switch are sufficiently decoupled in terms of diversity, with good average signal quality.

4. The diversity antenna according to claim 1, wherein said pair of antenna connection terminals is serially integrated in said at least one interruption site of said antenna conductor, so that the antenna signals are tapped ground-free, without a high frequency-conductive connection to the conductive frame.

5. The diversity antenna according to claim 2, wherein said pair of antenna connection terminals is serially integrated in a substantially electrically short connection of one of the two ends of said antenna conductor with the conductive frame, said short connection being effective at high frequency.

6. The diversity antenna according to claim 1, comprising a first additional antenna conductor connected to one of the two ends of said antenna conductor, said first additional antenna conductor being designed to match the impedance of the load of the suitably effective impedance Z2 associated with a high-frequency connection.

7. The diversity antenna according to claim 6, further comprising a second additional antenna conductor connected to said antenna conductor, said second additional antenna conductor being adapted so that a high-frequency load associated therewith at both ends in each case matched with a suitably effective respective impedance Z1 and Z2.

8. The diversity antenna according to claim 7, wherein said additional antenna conductors are formed from wires and are at least partly installed as an extension of said antenna conductor with a similar electrically small spacing from the conductive frame.

9. The diversity antenna according to claim 8, further comprising a plurality of additional interruption sites formed in said additional antenna conductors having an adequately large spacing from each other, and said electronically controllable impedance network designed as an electronic switch, and serially integrated in each of said at least one interruption site and said at least one additional interruption site.

10. The diversity antenna according to claim 9, wherein said spacing between said at least one interruption site and said plurality of additional interruption sites is larger than $\lambda/4$.

11. The diversity antenna according to claim 5, wherein said pair of antenna connection terminals is formed in the longitudinal train of said wire-shaped antenna conductor, and said antenna further comprises an additional pair of antenna connection terminals in the same site in the electrically short, high-frequency-effective connection on one of the two ends of said antenna conductor with the conductive frame, so that both the antenna signal existing between the antenna conductor and the conductive frame and the antenna signal present on said additional pair of antenna connection terminals are available in one site in the longitudinal train of said antenna conductor.

12. The diversity antenna according to claim 11, comprising an electronic change-over switch coupled to said antenna connection terminals, wherein one of the two available antenna signals is alternatively supplied for further processing in the network components of an antenna diversity system.

13. The diversity antenna according to claim 12, wherein said antenna conductor is installed in the form of a ring structure near the conductive frame and comprises at least one two-pole electronically controllable impedance network disposed within the dielectric area, wherein both the ground-based antenna signal between said ring structure and the conductive framing and the ground-free antenna signal in the longitudinal train of said antenna conductor are available for coupling to the network components of an antenna diversity system for further processing.

14. The diversity antenna according to claim 1, wherein at least one input control signal is provided to said electronically controllable impedance network for adjusting the effective impedance value between said first HF-connection site and said second HF-connection site, so that antenna signals that are different in terms of diversity are formed on said pair of antenna connection terminals by applying different control signals.

15. The diversity antenna according to claim 14, comprising at least one digitally adjustable electronic switching element having discrete switching conditions disposed in said electronically controllable impedance network, said switching element having reactances for adjusting discrete impedance values in response to said at least one control signal.

16. The diversity antenna according to claim 15, wherein said electronically controllable impedance network includes an electronic switching element in the form of a switching diode, wherein said diode is put in the open or closed condition in terms of high frequency in response to said control signal, so that either a connection that is effective in terms of high frequency, or an interruption in terms of high frequency exists between the connection terminals of the additional interruption site of said wire antenna conductor.

17. The diversity antenna according to claim 16, wherein feeding said control signal in the form of the passing current of said diode or its blocking voltage, a two-wire line is realized as a control line, so that the two-wire line is formed as a single wire antenna conductor in terms of high frequency by capacitive and inductive coupling of the conductors of the two-wire line, and said control signal is transmitted between the two conductors of the two-wire line.

18. The diversity antenna according to claim 17, wherein said impedance network comprises a coupling capacitance with only low impedance in the high frequency range, and an inductance with only high impedance in the high-frequency range to separate the high-frequency antenna signals and said control signals.

19. The diversity antenna according to claim 18, wherein said impedance network comprises passing on control signals across a first electronically controllable impedance network to an additional electronically controllable impedance network with the help of an additional wire antenna conductor in the form of a two-wire or multi-wire line located in the first controllable impedance network, switching elements blocking high-frequency signals including inductors are present for bridging said electronic switching element.

20. The diversity antenna according to claim 16, wherein said impedance network comprises for addressably controlling the electronic switching element with the help of coded control signals in the electronically controllable impedance network, for providing correspondingly coded signals to an additional controllable impedance network via an additional wire-shaped antenna conductor designed in the form of a two- or multi-wire line.

21. The diversity antenna according to claim 16, wherein said electronically controllable impedance network includes at least one impedance network for the frequency-selective passage or blockage of high-frequency signals of different radio areas, and coupled between the connection terminals of said additional interruption site of the wire-shaped antenna conductor.

22. The diversity antenna according to claim 1, comprising at least one connection network connected to said pair of antenna connection terminals and having network components, and wherein ground-free and/or ground-based antenna signals each are adapted to the receiver via said network components;

a switching processor for generating control signals and disposed in said connection network; and said control signals being further transmitted to at least one of said electronically controllable impedance network via a control line connected to said connection network.

23. The diversity antenna according to claim 1, comprising a diversity processor having a switching processor and electronic change-over switches, so that in the presence of a disturbed received signal in the receiver, a control signal for controlling said least one electronically controllable impedance network is generated in said switching processor, on the one hand, and, if need be, control signals of said switching processor are additionally generated for selecting ground-free or ground-based antenna signals with the help said electronic change-over switches, on the other hand, so that a multitude of switching possibilities and thus different received signals are available in any reception situation.

24. The diversity antenna according to claim 22, wherein the dielectric surface is formed by the plastic trunk lid surrounded by the electrically conductive body of the motor vehicle as the conductive frame, and said connection network is mounted in the proximity of the trunk lid fastening connected to the ground of the vehicle, and that the ground point forms the high-frequency ground of the connection network, and is electrically connected to the trunk lid fastening.

25. The diversity antenna according to claim 24, wherein for further diversifying the received signals or for forming two simultaneously available received signals, for diversity receivers with two inputs for in-phase superpositioning of the signals in the receiver in conjunction with a scanning diversity system, a first connection network is present in the proximity of the trunk lid fastening on the one side of the plastic trunk lid, and a second connection network is available in the proximity of the trunk lid fastening on the other side of the plastic trunk lid.

26. The diversity antenna according to claim 25, wherein for providing a scanning diversity system, for the UHF frequency range, intermediate-frequency (IF) signals of the receiver are supplied to said first connection network via the HF/IF frequency switch and to the diversity processor for testing the received signals for disturbances, wherein electronic change-over switches present in said second connection network are controlled via an antenna connection cable connecting said first connection network with said second connection network by control signals of said switching processor with switching address feed, and the received signal selected via the switching address signal evaluation and electronic change-over switches is supplied to said electronic change-over switch in said first connection network for further selection via an antenna connection cable leading to the receiver.

27. The diversity antenna according to claim 26, comprising television amplifiers for terrestrial television reception each comprising a connection to said wire antenna conductor are present in said antenna connection networks; said electronically controllable impedance networks being suitably distributed within the ring structure and include said impedance networks so that a strong UHF diversity reception in the UHF-range is provided.

28. The diversity antenna according to claim 1, wherein the dielectric surface is inserted in a cutout of the metallic roof of the motor vehicle, and is preferably square shaped, and extends over a substantial major part of the width of the roof.

* * * * *

UNITED STATES PATENT AND TRADEMARK OFFICE

CERTIFICATE OF CORRECTION

PATENT NO. : 6,603,434 B2
DATED : August 5, 2003
INVENTOR(S) : Lindenmeier et al.

It is certified that error appears in the above-identified patent and that said Letters Patent is hereby corrected as shown below:

Title page,
Item [73], Assignee, should correctly read:
-- [73] Assignee: Fuba Automotive GmbH & Co. KG
Bad Salzdetfurth (DE) --

Signed and Sealed this

Thirteenth Day of January, 2004

JON W. DUDAS
*Acting Director of the United States Patent and Trademark Office*